US007406843B2

(12) United States Patent
Thies et al.

(10) Patent No.: US 7,406,843 B2
(45) Date of Patent: Aug. 5, 2008

(54) REMOTE SUMP WITH FILM HEATER AND AUTO PURGE

(75) Inventors: Edward L. Thies, Creola, OH (US); Matthew C. Parsons, Dowagiac, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 624 days.

(21) Appl. No.: 10/983,942

(22) Filed: Nov. 8, 2004

(65) Prior Publication Data

US 2005/0120758 A1 Jun. 9, 2005

Related U.S. Application Data

(63) Continuation-in-part of application No. 10/141,293, filed on May 8, 2002, now Pat. No. 6,820,447.

(51) Int. Cl.
*D06F 39/10* (2006.01)

(52) U.S. Cl. ..... 68/18 F; 134/110; 134/111; 210/521; 210/519

(58) Field of Classification Search ..... 68/18 F, 68/18 R; 134/110, 111; 210/521, 519
See application file for complete search history.

(56) References Cited

U.S. PATENT DOCUMENTS 2,102,430 A * 12/1937 McLeod ..... 210/539
2,343,743 A * 3/1944 Breckenridge ..... 68/208
2,973,866 A * 3/1961 Genter et al. ..... 210/519
3,006,477 A * 10/1961 Karecki ..... 210/195.1
3,228,525 A * 1/1966 Evans et al. ..... 210/167.01
3,240,345 A * 3/1966 Butler et al. ..... 210/435
3,482,694 A * 12/1969 Culp et al. ..... 210/615
3,622,003 A * 11/1971 Czech et al. ..... 210/108
3,886,064 A * 5/1975 Kosonen ..... 209/157
4,202,778 A * 5/1980 Middelbeek ..... 210/522
4,351,733 A * 9/1982 Salzer et al. ..... 210/738
4,396,508 A * 8/1983 Broughton ..... 210/187
4,400,274 A * 8/1983 Protos ..... 210/302
4,485,645 A * 12/1984 Mulder et al. ..... 68/18 F
4,487,692 A * 12/1984 Kersten ..... 210/194
4,780,206 A * 10/1988 Beard et al. ..... 210/521
5,076,937 A * 12/1991 Montgomery ..... 210/705
5,904,850 A * 5/1999 Vellinga ..... 210/603

FOREIGN PATENT DOCUMENTS

DE 39 29 044 * 3/1991

* cited by examiner

*Primary Examiner*—Frankie L Stinson
(74) *Attorney, Agent, or Firm*—Clifton Green; Michael D. Lafrenz

(57) ABSTRACT

An automatic washer comprises a remote sump fluidly connected to a drain pump and a recirculation pump, and a separator comprising an array of regularly-spaced fins oriented upstream of the recirculation pump for intercepting foreign objects in wash liquid. The remote sump also comprises a wash liquid heater. The separator is automatically purged when the drain pump is operated.

25 Claims, 8 Drawing Sheets

REMOTE SUMP WITH FILM HEATER AND AUTO PURGE

CROSS-REFERENCE TO RELATED APPLICATION

This application is a continuation-in-part of U.S. application Ser. No. 10/141,293, filed May 8, 2002, now issued as U.S. Pat. No. 6,820,447.

BACKGROUND OF THE INVENTION

1. Field of the Invention

The present invention relates to automatic washers and in one aspect to a remote sump having a baffle trap for intercepting foreign objects in wash liquid. In another aspect, the invention relates to a remote sump comprising a wash liquid heater. In another aspect, the invention relates to a baffle trap which is automatically purged when a drain pump connected to the remote sump is operated.

2. Description of the Related Art

In automatic clothes washers, it is preferred that only fabric materials be placed into the wash zone of the wash tub, however, other objects make their way into the wash zone including buttons, keys, stones and pebbles, small metal objects, etc. which can cause damage to the pumps used in the automatic washers such as the recirculation pump and the drain pump.

In some washers it is desirable to use motors such as synchronous motors to drive the recirculation pumps. These types of motors have relatively low efficiency and low torque, but are also low cost. Flow rates through these recirculation pumps are maximized by maintaining a close relationship between the impeller and the pump housing. These factors make this type of pump very susceptible to problems caused by foreign materials. Foreign materials are easily trapped between the impeller and housing because of the close relationship. Low torque of the driving motor causes the trapped materials to completely stop the pump.

Collecting and holding foreign materials can cause a number of problems. Collected materials can eventually reduce flow rates by obstructing the water flow path. Some collected materials deteriorate with time and may be redistributed on clothing or cause odor. Other types of materials may add to the accumulation process by causing materials to accumulate that might otherwise be pumped down the drain.

A foreign objects trap is disclosed in U.S. Pat. No. 4,485,645 in which a container is provided which has a water inlet in communication with a tub outlet. The water inlet terminates just short of a floor of the container and the water is then required to pass up through a plate which has irregularly shaped tubes therethrough for preventing passage of foreign objects. Lint is specifically permitted to pass through the foreign objects trap and all of the water exits from the container through a single outlet leading to a single pump which is utilized to both recirculate water and drain water, depending upon the position of a valve located downstream of the pump. Thus, this foreign objects trap has a disadvantage of allowing lint to be recirculated onto the clothes load and also accommodates only a single pump.

U.S. Pat. No. 4,833,900 discloses a foreign objects filter for an automatic washer through which all of the water from the wash tub is directed. In an embodiment, one part of the filter comprises a fine mesh filter and the outlet of that portion leads to the recirculation pump. The other side of the filter has a coarse mesh and its outlet leads to the drain pump. In a second embodiment, only a coarse filter is provided whose outlet leads to either the recirculation pump or the drain pump. This device permits the passage of small, but heavy objects, such as nails and screws to the drain pump, potentially causing damage to that pump.

SUMMARY OF THE INVENTION

An automatic clothes washer comprises a wash tub for holding wash liquid, a wash basket located within the wash tub for holding items to be washed, a wash liquid dispenser for introducing wash liquid into at least one of the wash tub and wash basket, a sump located remotely of the wash tub and comprising a housing having an inlet fluidly connected to the wash tub such that wash liquid in the wash tub can flow through the inlet into the sump, and the flow of wash liquid through the inlet into the sump defines a primary flow path, a recirculation pump having an inlet fluidly coupled to the sump housing and an outlet fluidly coupled to the wash liquid dispenser for fluidly coupling the sump and the wash liquid dispenser to effect the recirculation of the wash liquid through the wash tub, a drain pump having an inlet fluidly coupled to the sump housing and an outlet fluidly coupled to a drain to effect the draining of water from the sump, and a separator located within the sump housing for removing objects entrained in the wash liquid, the separator having multiple through openings, with each of the through openings defining a through opening flow path, the separator is located within the sump housing such that wash liquid flowing from the sump inlet to the recirculation pump inlet passes through at least one of the multiple through openings and the primary flow path of the wash liquid defines an included angle of less than or equal to ninety degrees with at least one of the through opening flow paths.

The primary flow path can define an included angle of less than or equal to ninety degrees with all of the through opening flow paths, a range of included angles between 30 and 50 degrees, with a preferred included angle of 45 degrees.

The separator can comprise multiple, spaced fins, with the space between adjacent fins defining a through opening. Each fin can define a first axis, and the first axis of at least one of the fins can define an included angle of less than or equal to ninety degrees with the primary flow path. All of the first axes can define an included angle of less than or equal to ninety degrees. All of the fins can define the same included angle.

Each of the fins can define a second axis, and the second axis of at least one of the fins defines an included angle between 50 and 90 degrees. All of the second axes can define an included angle of 60 degrees.

Each fin can also form a complex angle such that the space between adjacent fins defines a curved flow-through path having the through opening as its inlet. A barrier wall can be provided that intersects the fins and is oriented substantially parallel to the primary flow path.

The sump can define an interior height and at least one of the fins can effectively span the extent of the interior height. The fins in front of the reciprocating pump inlet can effectively span the extent of the interior height, and all of the fins can effectively span the extent of the interior height.

The separator can comprise a screen having multiple openings forming the through openings.

The sump inlet can define a first plane perpendicular to a longitudinal axis of the sump inlet, the recirculation pump inlet can define a second plane perpendicular to a longitudinal axis of the recirculation pump inlet, and the first and second planes can define an included angle of less than or equal to ninety degrees. The sump inlet and the recirculation pump inlet can be located at substantially the same height relative to the sump housing.

The drain pump inlet can be located downstream of the recirculation pump inlet relative to the sump inlet. The sump housing can further comprise a clean-out opening, and the clean-out opening can be located downstream of the drain pump inlet.

A heater can be located within the sump. The heater can be a heating element lying substantially flat along a portion of the sump housing. The heating element can be a film heating element.

The sump housing can define an elongated chamber having a central axis defining the primary flow path with the sump inlet located at one end such that wash liquid enters the elongated chamber parallel to the primary axis, and the recirculation pump inlet and drain pump inlet are located along a side of the elongated housing. The separator can be oriented generally parallel to the central axis.

DETAILED DESCRIPTION OF AN EMBODIMENT OF THE INVENTION

The present invention relates to a remote sump comprising a trap for foreign objects to be used in conjunction with an automatic clothes washing machine. Any type of configuration of clothes washing machine can utilize the remote sump and trap of the present invention, whether that washing machine is a vertical axis machine, a horizontal axis machine, a tilted axis machine, a machine with a wobble plate, an impeller, or any other clothes moving arrangement.

In any type of clothes washing apparatus, an object of the apparatus is to remove dirt, odors, stains and other materials from the fabric being cleaned. Oftentimes this results in the removal or separation of various foreign objects which have been carried along with the fabric load. In any type of automatic washing appliance it would be useful to have an arrangement for segregating and removing such objects from the wash liquid, which is provided by the present invention.

Figure 1:
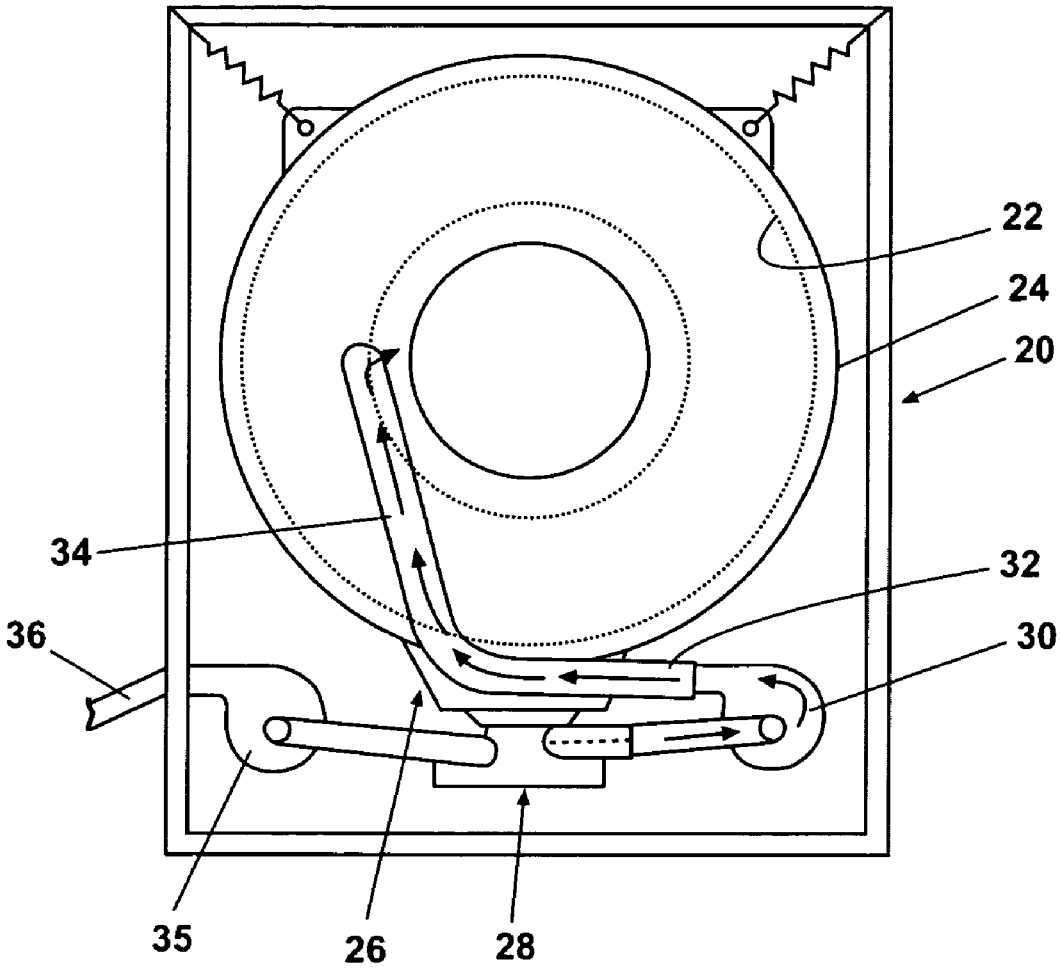
FIG. 1 is a perspective view of an automatic washer embodying the principles of the present invention.

Merely as an illustrative example, FIG. 1 illustrates an automatic washer 20 which is of a horizontal axis rotating type having a rotatable wash drum 22 carried inside of a wash tub 24. At the lower end of the wash tub 24 is a sump 26 where wash liquid collects and which then passes into a foreign objects trap 28. The wash liquid then continues to a pump 30 for recirculation to the wash tub 24 through a recirculating conduit 34 or to a pump 35 to be directed to a drain conduit 36. The drain conduit 36 may lead to a drain to dispose of the wash liquid, or may lead to a tank or other reservoir where the wash liquid is collected before being treated and reused in the washer 20.

Figure 2:
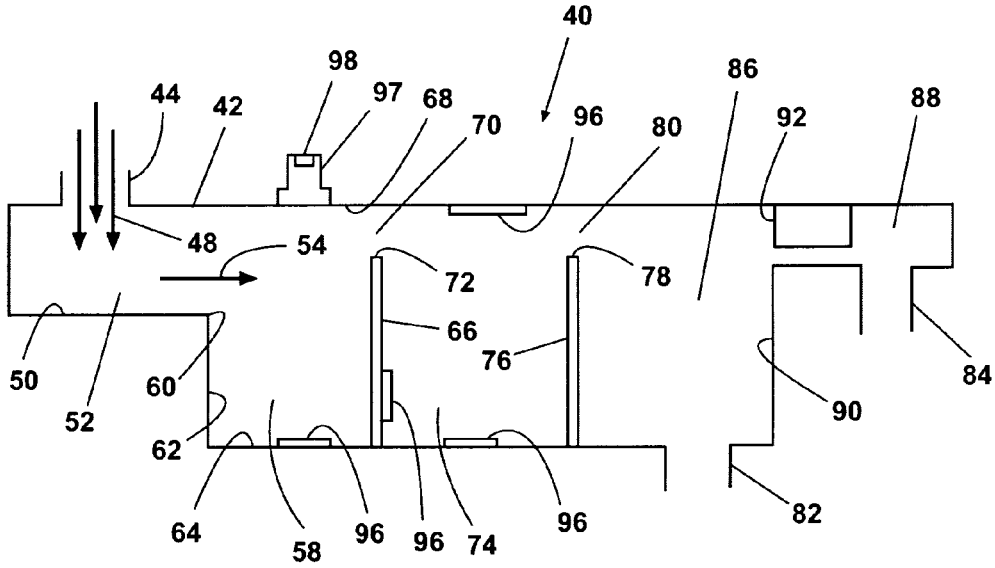
FIG. 2 is a schematic illustration of a foreign objects trap embodying the principles of the present invention.

FIG. 2 schematically illustrates a foreign objects trap 40 embodying the principles of the present invention. The foreign objects trap 40 is comprised of a container 42 having an inlet 44 which communicates with the wash tub 34. As described below, it is not necessary for the wash tub to be provided with a separate sump, however, the outlet from the wash tub 24 which connects to the inlet 44 should be positioned at a lowermost point in the wash tub in order to effect complete draining of wash liquid from the wash tub.

The inlet 44 defines an initial flow path 48 for liquid from the wash tub 24 into the foreign objects container 42. A first wall 50 is positioned in an impact orientation relative to the initial flow path 48, such as by being substantially perpendicular to the initial flow path and closely adjacent to and downstream of the inlet 44. With this arrangement, the wash liquid, and any foreign objects carried along therewith, will impact the wall 50, thereby reducing some of the kinetic energy of the foreign objects which are carried along with the liquid stream.

The wall 50 forms a portion of an inlet chamber 52 which includes the inlet opening 44. After the wash liquid strikes the wall 50, the flow path is diverted to a direction 54 substantially parallel to the impact wall 50. Downstream of the wall 50 and inlet chamber 52 is a quiet zone 58 which may be defined, at one side, by an end 60 of the wall 50. The quiet zone 58 may have a cross sectional area, perpendicular to the new flow path 54, which is greater than a cross sectional area of the inlet chamber 52, perpendicular to the flow path 54, such that the velocity of the wash liquid passing through the quiet zone 58 will be substantially reduced. The quiet zone 58 may also have a greater depth than the inlet chamber 52, such as provided by a vertical wall 62 leading to a floor 64 forming a bottom wall of the container 42. Heavy foreign objects, no longer carried along by the slower flowing wash liquid, will drop to the floor 64 as the liquid stream passes from the inlet chamber 52 to the quiet zone 58.

A baffle 66 is provided downstream of the quiet zone 58 and, in the embodiment illustrated, forms a downstream edge of the quiet zone. The baffle 66 may extend upwardly from the floor 64 and terminate short of a top wall of the container, thus defining a passage 70 leading from the quiet zone 58. Preferably a top end 72 of the baffle 66 has a higher elevation than the wall 50 further reducing the likelihood that heavy and dense objects would be carried through the passage 70 since their kinetic energy was reduced upon striking the wall 50. The liquid flowing through the passage 70 may next move into an optional second quiet zone 74, downstream of the first quiet zone 58. The second quiet zone 74 may, as in the embodiment illustrated, be defined at an upstream side by the baffle 66 and at a downstream side by a second baffle 76. Again, a top end 78 of the second baffle preferably is higher than the level of the impact wall 50. The second quiet zone 74 merely provides an additional area where heavy and dense objects may settle out from the flow path.

A second outlet passage 80 is provided between the top of the second baffle 78 and the top wall 68. Downstream of the second outlet passage 80 is an outlet 82 leading to a drain pump. When the drain pump is not operating, wash liquid is prevented from flowing through the outlet 82 and so the wash liquid passes further in the container 42, downstream to an outlet 84 leading to the recirculation pump.

A space 86 which communicates directly with the outlet 82 to the drain pump preferably has a large cross sectional area so that any relatively large, but light or low density objects, such as toothpicks, can easily pass through the area 86 to the drain outlet 82. An area 88 communicating with the outlet 84 to the recirculation pump, however, is constricted by a wall 90 which obstructs passage of relatively large objects into the recirculating pump outlet 84, thereby preventing such objects from being redistributed onto the fabric material being washed. Further, a filter mechanism 92 may be provided between the drain outlet 82 and the recirculating outlet 84 so as to capture and retain small or light objects, such as lint, to prevent such objects from being redistributed on to the fabric load.

During a drain portion of the cycle, wash liquid is drawn in through the inlet 44, as well as from the recirculation outlet 84, and thus is drawn in a reverse direction through the filter mechanism 92, thereby self cleaning the filter mechanism and causing any collected material to be dispensed through the outlet 82 to the drain.

Figure 3:
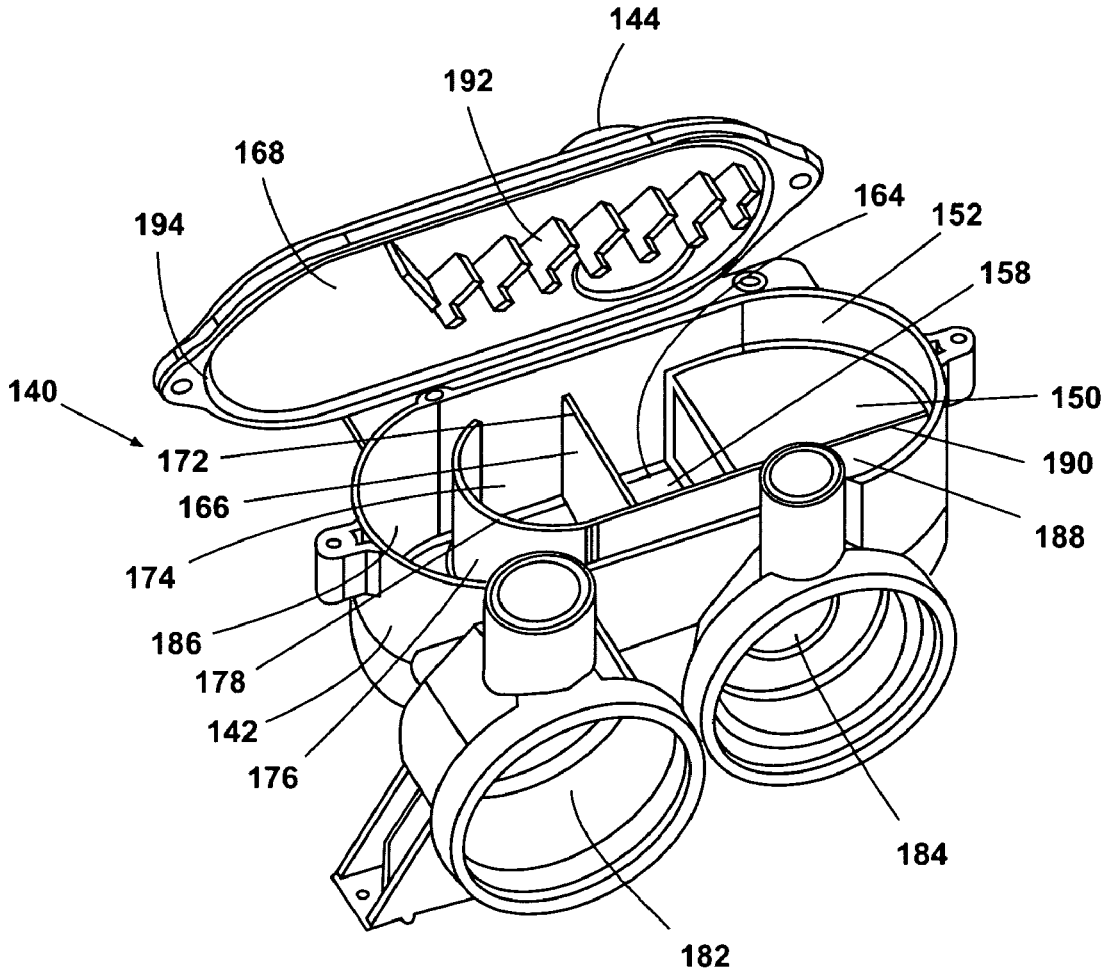
FIG. 3 is a perspective view of a lint filter and foreign objects trap embodying the principles of the present invention.

A particular commercial embodiment of the invention is illustrated in FIG. 3 which shows a foreign objects trap 140 in an open condition to allow visualization of interior components. A foreign objects trap 140 includes a container 142 having an inlet 144 which passes through a top wall 168 of the container. The inlet 144 is positioned directly over a wall 150 which is arranged perpendicular to and closely adjacent to the inlet 144 and defines an inlet chamber 152. Downstream of the inlet chamber is a first quiet zone 158 which is substantially deeper than the inlet chamber 152 and includes a floor 164 which forms a bottom of the container 142. A first baffle 166 defines a downstream edge of the first quiet zone 158 and has a top edge 172 with an elevation greater than the impact wall 150. Downstream of the first baffle 166 is a second quiet zone 174 defined between the first baffle 166 and a second baffle 176. Again, a top edge 178 of the second baffle 176 is positioned above the level of the impact wall 150.

Downstream of the second baffle 176 is an area 186 which communicates with an outlet 182 leading to the drain pump. Farther downstream, within the container 142, is an outlet 184 which leads to the recirculation pump. An area 188 which communicates with the recirculation pump outlet 184 is reduced in its cross sectional dimension compared to the area 186 due to the position of a wall 190 which confines the area. Positioned between the outlet 182 to the drain pump and the outlet 184 to the recirculation pump is a filter mechanism 92 which, in the embodiment illustrated, is a series of fins depending downwardly from the top wall 168 which extend into the flow path of the liquid being directed to the recirculation pump outlet 184 and positioned to capture any light or low density foreign objects which would be carried along near the top of the flow path. The fins are shown as being positioned in an angled orientation relative to the flow path so as to provide a greater surface area for collecting any floating foreign objects.

In the embodiment of FIG. 3, the top wall 68 forms a removable cover which can be secured to the remainder of the container 142, such as by threaded fasteners, and includes a seal 194 to prevent leakage between the cover and the remainder of the container.

As a further enhancement for either embodiment, a heating element 96 (FIG. 2) can be provided inside of the container 42, such as positioned on the floor 64, in either or both of the quiet zones 58, 74, on a vertical wall, such as baffle 66, and/or on the top wall 68, or the heater element 96 can be arranged in an elevated position at any location within the container 42. In this manner, the heating element can be removed from its typical location in the sump of the washer, thereby allowing the sump to be dramatically reduced in size, or eliminated all together, thus reducing a volume of water held in the wash tub which is not currently being utilized to treat the fabric in the wash tub. This can lead to reduced water consumption by the washer.

By providing the heating element 96 in the foreign objects trap container 42, it will be assured that the heating element is always submerged in wash liquid, thereby preventing a situation where the element is exposed which could lead to overheating.

In a preferred arrangement, the heating element 96 can take the form of a film heater which can be applied directly to one of the walls of the container 42 or which can be molded together with the material forming the container 42 which would allow the container 42, now acting as a remote sump, to retain its compact features while still incorporating the heater. The film heater may be in the form of a resistive element which is printed by silk screening or other similar processes into a desired pattern on one or more of the interior walls of the container 42.

The top wall 68 may also include an air dome 97 which retains a volume of air, even when the container 42 is filled with wash liquid. The air dome could include a pressure sensor 98 which can be used to determine water levels or possible flood condition in the wash tub. Providing the pressure sensor 98 in the foreign objects trap container 42 helps to reduce costs for the pressure sensing function.

FIGS. 4-8 illustrate an embodiment of the invention comprising a remote sump 200 with an integral foreign objects trap, rather than the previously described sump 26 which is integral with the wash tub 24. The embodiment illustrated in FIGS. 4-8 comprises several elements of the automatic washer 20 previously described herein and, thus, like elements will be identified with like numerals.

Figure 4:
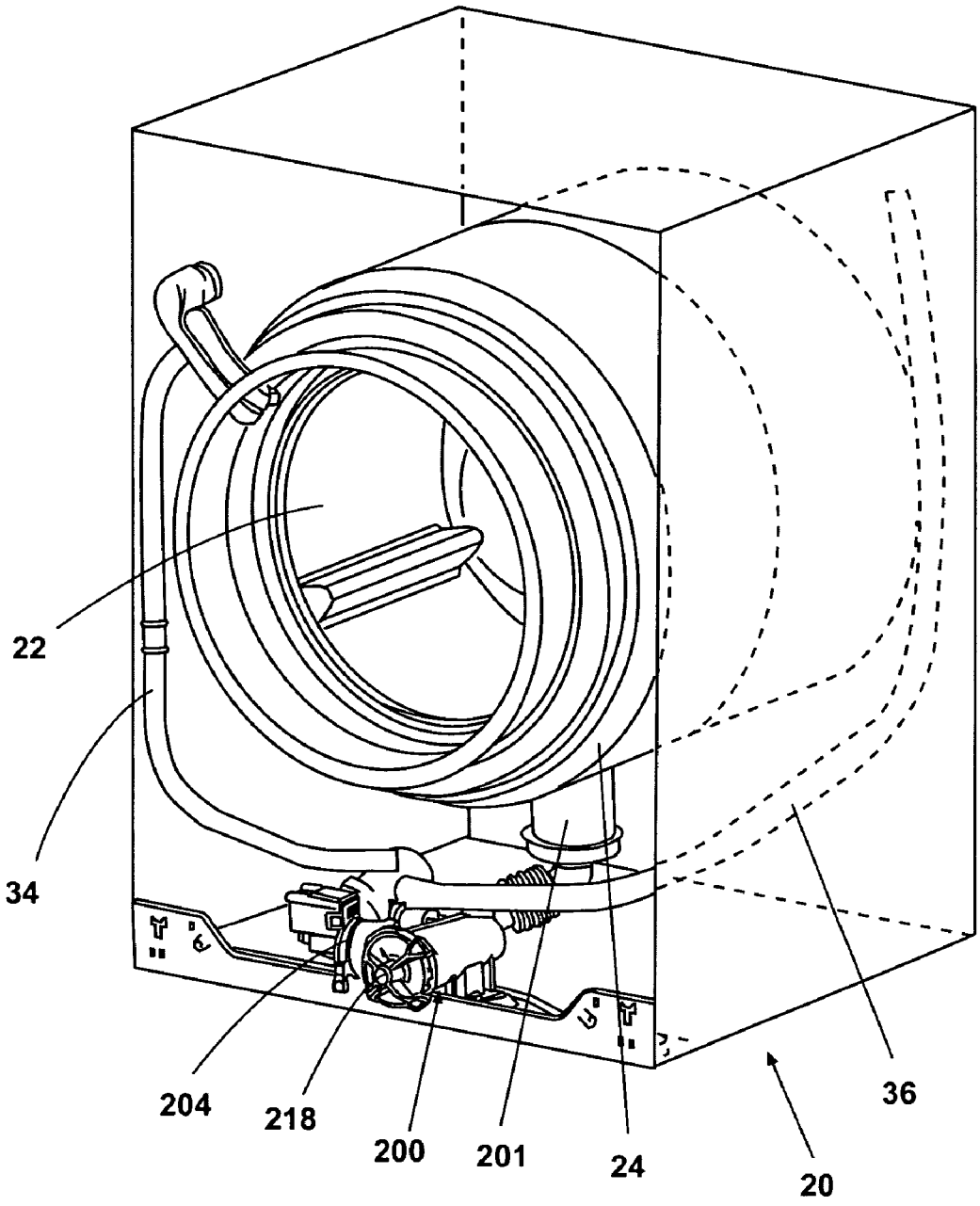
FIG. 4 is a schematic view of an automatic washer comprising a remote sump according to the invention.

As illustrated in FIG. 4, an automatic washer 20 comprises a horizontally rotating wash drum 22 carried inside a wash tub 24. A wash tub outlet 201 is fluidly connected to the wash tub 24 at a lower portion thereof for draining wash liquid from the wash tub 24. The wash tub outlet 201 is fluidly connected to the remote sump 200. One benefit of the remote sump 200 is that it can be placed anywhere within the cabinet housing of the wash tub. As illustrated, the remote sump 200 is located near the front of the cabinet to provide for easy access to and cleaning out of the remote sump 200.

Figure 5:
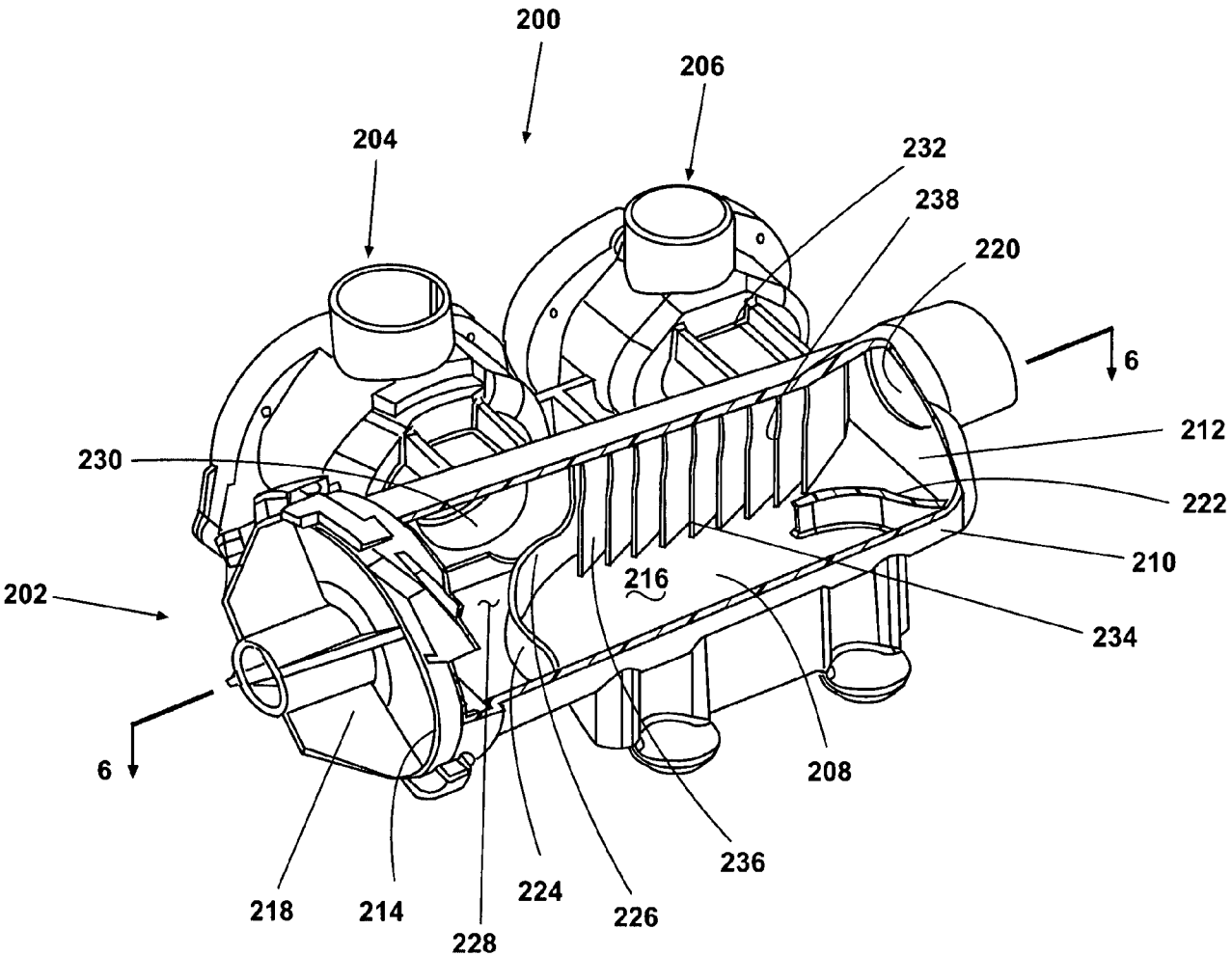
FIG. 5 is a perspective view of the remote sump illustrated in FIG. 4 having a foreign objects trap and a lint filter comprising a plurality of fins extending the full height of the remote sump, with portions of an exterior wall cut away for viewing the interior of the remote sump.
Figure 6:
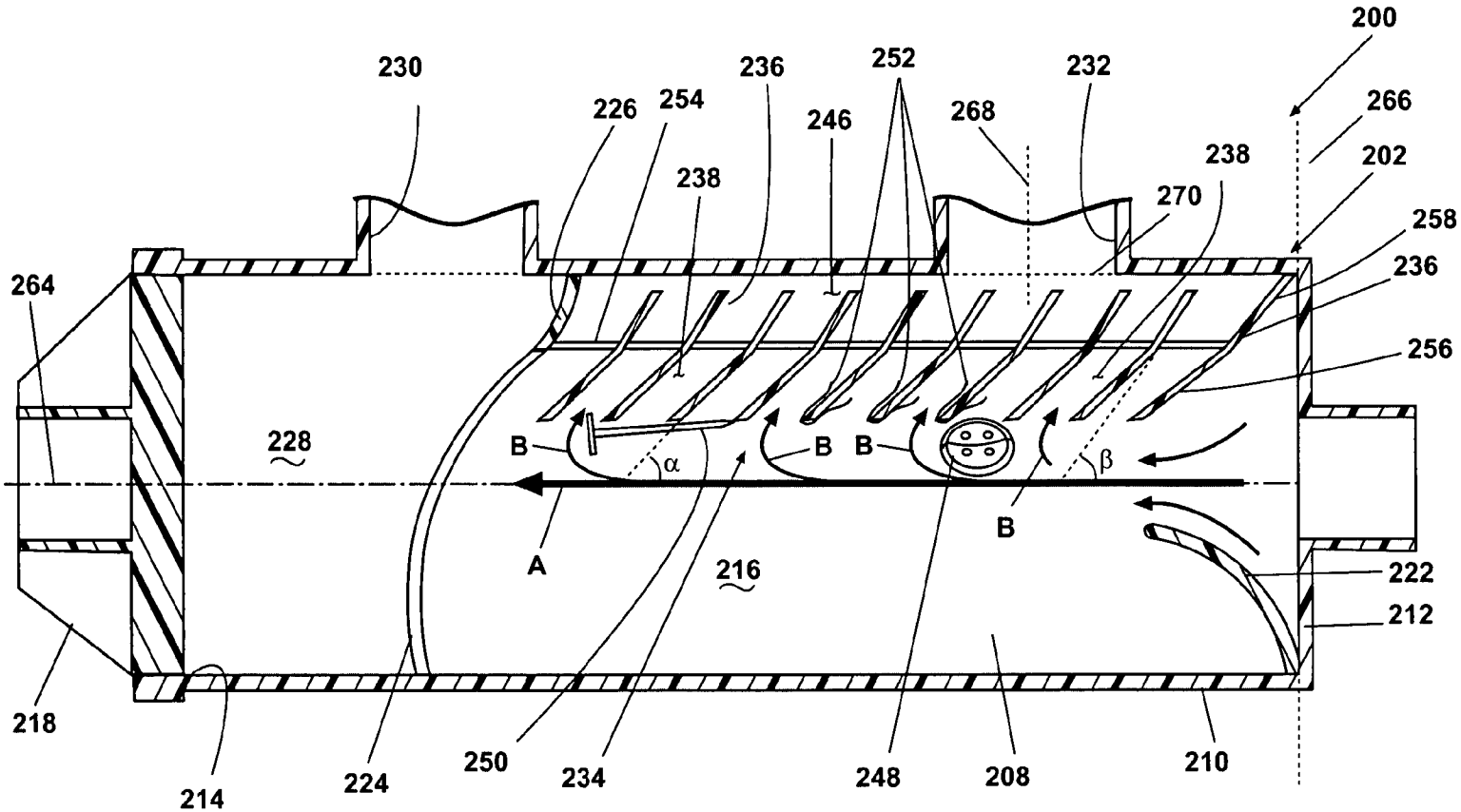
FIG. 6 is a sectional view taken along view line 6-6 of FIG. 5.

Referring to FIGS. 5 and 6, the remote sump 200 is illustrated with a portion of the sump body removed for revealing the interior structure of the remote sump 200. The remote sump 200 comprises a generally elongated, hollow cylindrical sump body 202. The sump body 202 comprises a cylindrical wall 210 terminating at a first end in an end wall 212 and at a second end in a cleanout opening 214. The cylindrical wall 210 can be provided at an uppermost portion in a well-known manner with an air trap (not shown) extending away from the sump body 202, such as a longitudinal channel, a chamber, or the like, to enable air entering the sump body 202 to be entrapped and vented, thereby preventing air from entering a pump which can create cavitation, noise, and impeller blockage problems.

The cleanout opening 214 is selectively closed with a removable cleanout cap 218. The cylindrical wall 210, the end wall 212, and the installed cleanout cap 218 define an interior chamber 216. The bottom of the interior chamber 216 terminates in a planar floor 208 extending from the end wall 212 to the cleanout opening 214.

The end wall 212 is provided with an inlet opening 220 at an upper portion thereof which is adapted for fluid communication with the wash tub outlet 201. Preferably, the inlet opening 220 will be connected to the wash tub outlet 201 through a conventional fluid-tight connection, such as a suitable hose. The cleanout cap 218 and the cleanout opening 214 are adapted for conventional installation of the cleanout cap 218 in the cleanout opening 214, such as by a threaded or friction-fit connection.

Extending radially away from the cylindrical wall 210 are a generally conventional drain pump assembly 204 and recirculation pump assembly 206, which are fluidly connected to the interior chamber through drain pump inlet 230 and recirculation pump inlet 232, respectively. The drain pump assembly 204 is fluidly connected to the drain conduit 36 for draining of wash liquid to an exterior drain (not shown). The drain pump assembly 204 preferably comprises a generally conventional drain pump that is capable of handling typically encountered hard and soft foreign objects, such as screws, curtain hooks, buttons, hair, lint, and the like. Such a pump has a designed capability to pass foreign objects through a drain with little potential for jamming of the pump.

The recirculation pump assembly 206 comprises a generally conventional recirculating pump, which is typically less robust than the drain pump at passing foreign objects. The recirculation pump assembly 206 is fluidly connected to the recirculating conduit 34 for recirculation of wash liquid to the wash tub 24.

Because the recirculation pump is less robust at passing foreign objects and because it is preferred to prevent the recirculation of foreign objects into the wash basket, a foreign objects trap is incorporated into the remote sump 200. FIGS. 5 and 6 illustrate a first embodiment of the foreign objects trap comprising a separator in the form of a fin assembly 234 and an obstruction wall 224, both located downstream of the inlet 220.

An arcuate baffle 222 extends orthogonally away from the floor 208 into the chamber 216 adjacent the end wall 212. The curvature of the baffle 222 is away from the end wall 212, and effectively reduces the cross-sectional area of the chamber 216 immediately downstream of the inlet 220, which increases the speed of the wash liquid flowing in from the inlet opening 220 along a path that is generally parallel to the fin assembly and defines a primary flow path, designated by arrow A, of the wash liquid through the chamber 216. The baffle 222 extends the full height of the chamber 216.

The arcuate obstruction wall 224 extends orthogonally away from the floor 208 into the chamber 216 adjacent the cleanout opening 214. The curvature of the obstruction wall 224 is away from the cleanout opening 214 and against the flow of wash liquid along the primary path A from the inlet opening 220. The obstruction wall 224 extends somewhat less than the full height of the chamber 216 to enable flow of wash liquid over the obstruction wall 224. The obstruction wall 224 transitions adjacent the fin assembly 234 to a chamber wall 226 extending orthogonally away from the floor 208 the full height of the chamber 216. The obstruction wall 224 and the chamber wall 226 define with the installed cleanout cap 218 a drain pump chamber 228. The drain pump chamber 228 is fluidly connected to the drain pump inlet 230.

Extending in a linear array from the chamber wall 226 to the end wall 212 is a separator comprising a fin assembly 234. The fin assembly 234 is spaced somewhat inwardly of the cylindrical wall 210 to define a recirculation pump chamber 246 extending from the chamber wall 226 to the end wall 212 and fluidly connected with the recirculation pump inlet 232.

The fin assembly 234 comprises a plurality of regularly-spaced, generally parallel fins 236 extending orthogonally away from the floor 208 the full height of the chamber 216 and separated by a plurality of slots 238, which define pass through openings and a pass through opening flow path to the recirculation inlet 232.

The fins 236 are intersected by a lateral wall 254 which extends parallel to the longitudinal axis of the sump body 202 from the chamber wall 226 to the fin 236 nearest the end wall 212. The lateral wall 254 extends less than the full height of the chamber 216 so that liquid can flow over the lateral wall 254 to the recirculating pump inlet 232, but foreign objects that cannot float will be blocked by the wall 254.

As illustrated, the fins 236 bend at their intersection with the lateral wall 254 to form a complex angle relative to the primary flow path. The portion of the fins 236 in front of the wall 254 has a first axis that defines an included angle $\alpha$ with the primary flow path A. This angle $\alpha$ is between 30 and 50 degrees. With respect to a longitudinal axis 268 of the recirculation pump inlet 232 (which is perpendicular to the flow path A), the angle of the portion 256 is between 40 and 60 degrees. In a preferred embodiment, the included angle $\alpha$ is 45 degrees.

The portion 258 of the fins 236 extending to the exterior from the lateral wall 254 has a second axis that defines an included angle $\beta$ with the primary flow path A of between 50 and 90 degrees. With respect to the longitudinal axis 268 of the recirculation pump inlet 232, the angle of the portion 258 is less than 40 degrees. The included angle $\beta$ is preferably 60 degrees. Preferably, the angle of inclination of the portion 258 relative to the portion 256 is 15 to 20 degrees.

The fins 236 and slots 238 are configured to prevent the introduction of foreign materials, such as a button 248 or a nail 250, into the recirculation pump chamber 246 and the recirculation pump assembly 206. The spacing and dual angle configuration of the fins 236 from the cylindrical wall 210 will prevent thin or elongated foreign materials, such as toothpicks or hairpins, entering the slots 238 from orienting themselves so as to pass through the recirculation pump inlet 232. The fins 236 are also oriented relative to the primary flow path A such that the slots 238 open toward the cleanout opening 214, which aids in the removal of lint and other items that might wrap around the leading edges of the fins 236.

More specifically, the complex angle on the fins 236 is important in order to prevent elongated foreign objects such as pins, toothpicks, and the like from passing through the fins 236 and into the recirculating pump inlet 232. The complex angle forms a corner that such elongated objects cannot turn given the narrow spacing of the slots 238, thereby trapping the elongated objects.

The included angle $\alpha$ being less than or equal to 90 degrees to the primary flow path A is important in that it forces the wash liquid make at least a 90 degree turn along path B to pass through the slots 238 and precludes the direct flow of wash liquid from the inlet 220 to the recirculation inlet 232. This change in flow direction facilitates a change in both the speed (slower) and direction of the wash liquid, which facilitates the deposition of foreign materials in the chamber 216, and also facilitates the deposition of lint or hair 252 on the leading edges of the fins 236.

While preferred ranges for the angles of the illustrated embodiment have been described, it should be noted that the number of fins, the thickness, width, and height of the fins, and the angle of inclination of the fins with respect to the longitudinal axis of the sump body 202 are selected based upon the size of foreign materials to be filtered and the flow characteristics of the pump assemblies 204, 206. Similarly, the slots 238 are configured based upon the size of foreign material that can be safely passed to the recirculation pump assembly 206 without damage to the recirculation pump or adverse effect on items being washed.

It should also be noted that while the fins are illustrated with a complex angle, it is within the scope of the invention for the fins to be straight. In such a configuration, the angles $\alpha$ and $\beta$ would have the same value and the fins would have only one axis.

During operation of the drain pump assembly 204, wash liquid will flow from the inlet opening 220 along the fin assembly 234 and over the obstruction wall 224 into the drain pump chamber 228, to exit the sump body 202 through the drain pump inlet 230. Suspended and partially suspended smaller foreign materials will be swept over the obstruction wall 224 to be removed through the drain pump assembly 204. Heavier or larger foreign materials will be entrapped within the chamber 216, to be removed through the cleanout opening 214. Very little, if any, material will collect on the leading edges of the fins 236 since the wash liquid will tend to flow out the drain pump and not into the slots 238 between the fins 236.

During operation of the recirculation pump assembly 206, wash liquid will flow from the inlet opening 220 and through the fin assembly 234 along the primary flow path A. The operation of the recirculation pump redirects the wash liquid into the slots 238 between the fins 236 and into the recirculation pump chamber 246, to exit the sump body 202 through the recirculation pump inlet 232. Foreign materials will be prevented from passing through the fin assembly 234, except for very fine materials having a preselected size. Heavier or larger foreign materials, such as a button 248 or a nail 250, will remain in the chamber 216. Lint, hair, and like materials 252 will be collected on the leading edges of the fins 236 because the wash liquid flow must effectively wrap around the leading edge of the fins 236 to reach the recirculation pump inlet 232. Once trapped, the lint or hair 252 will act as a filter, further trapping additional lint and hair 252, thus limiting the quantity of lint or hair 252 entering the recirculation pump assembly 206 to quantities that the pump assembly 206 can handle without jamming.

When the operation of the recirculation pump assembly 206 is terminated and the operation of the drain pump assembly 204 is initiated, some foreign materials blocked by the fin assembly 234 and collected in the chamber 216 will be flushed over the obstruction wall 224 into the drain pump chamber 228 and through the drain pump inlet 230. Lint and hair 252 will also be flushed from the fin assembly 234 to be removed through the drain pump inlet 230. Wash liquid flowing from the recirculation pump assembly 206 into the sump body 202 through the recirculation pump inlet 232 will facilitate the removal of lint and hair 252 and other foreign materials collected in the chamber 216. The inclination of the fins 236 enables collected materials, such as lint or hair 252, to dislodge from the fins 236 when the drain pump assembly 204 is operated.

Figure 7:
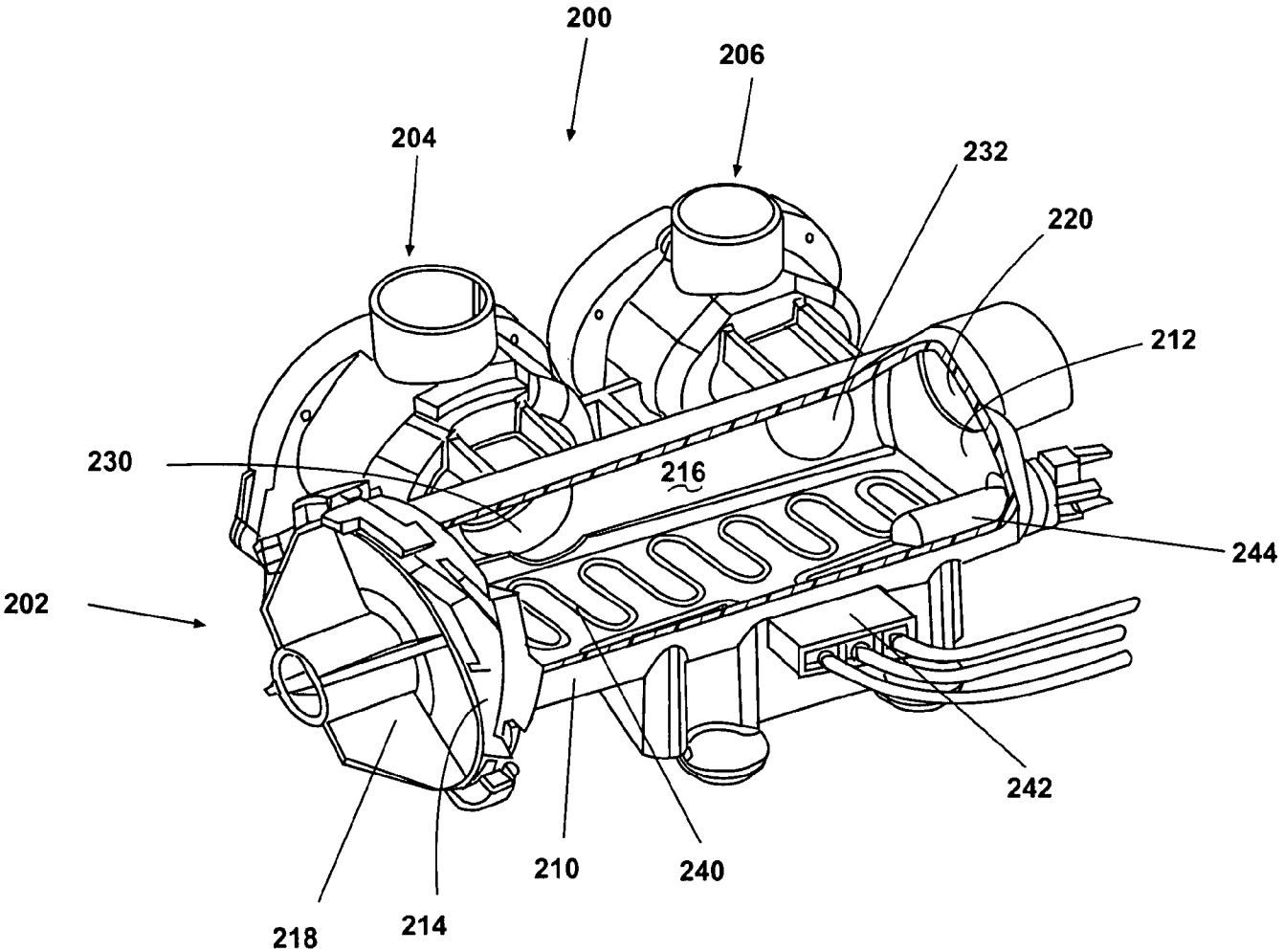
FIG. 7 is a perspective view of an embodiment of the remote sump illustrated in FIG. 5 having a film heater element, with portions removed for clarity.

FIG. 7 illustrates an embodiment of the remote sump 200 having a generally conventional film heater element 240 in a lower portion of the chamber 216 in place of or on top of the floor 208. The baffle 222, obstruction wall 224, chamber wall 226, and fin assembly 234 have been removed for clarity. The film heater element 240 is preferably powered by electricity provided from the electrical system of the automatic washer 20 through a conventional heater connector block 242. A well-known thermistor 244 can be provided in the chamber 216 for controlling the temperature of the wash liquid heated by the film heater element 240.

Figure 8:
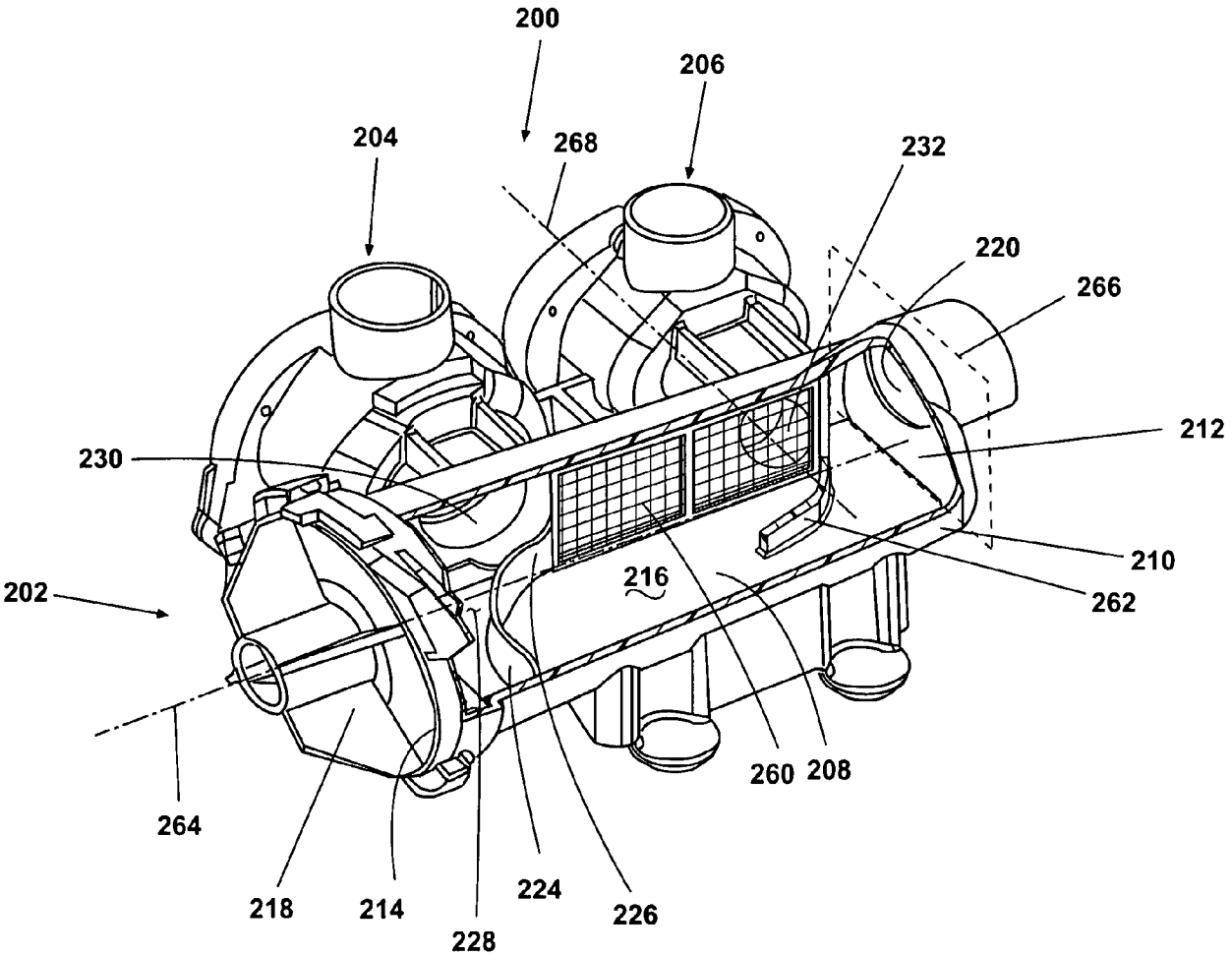
FIG. 8 is a perspective view of an embodiment of the remote sump illustrated in FIG. 4 having a foreign objects trap and a lint filter comprising a screen, with portions of an exterior wall cut away for viewing the interior of the remote sump.

While the fin assembly 234 is the preferred type of separator, other types of separators can be used. For example, as illustrated in FIG. 8, the fin assembly 234 can be replaced with a screen or mesh 260 that extends over the recirculation inlet 232. The screen or mesh 260 defines multiple pass through openings, which serve as inlets to a pass through flow path, which typically has a length equal to the thickness of the screen. The screen is less desirable in that it can require more frequent cleaning. However, the easily accessible cleanout opening 214 reduces the inconvenience of the increased maintenance.

The mesh size, i.e. the size of the openings, is selected based upon the size of foreign materials to be filtered and the flow characteristics of the pump assemblies 204, 206. The mesh size is selected based upon the size of foreign material that can be safely passed to the recirculation pump assembly 206 without damage to the recirculation pump or adverse effect on items being washed.

With the use of a screen or mesh 260, the baffle configuration is modified from the arcuate baffle 222 illustrated in FIG. 5 to an arcuate baffle 262 illustrated in FIG. 8. The arcuate baffle 262 extends orthogonally away from the floor 208 the full height of the chamber 216 adjacent the end wall 212 away from the screen or mesh 260. The curvature of the baffle 262 is away from the end wall 212, and effectively reduces the cross-sectional area of the chamber 216 immediately downstream of the inlet 220, which increases the speed of the wash liquid flowing along a path that is generally parallel to the screen or mesh 260, essentially the same as the primary flow path A. The baffle 262 directs the flow of liquid away from the screen or mesh 260, thus forcing a change in direction of the flow through the screen or mesh 260 which will facilitate the deposition of particles in the chamber 216.

Whether a fin assembly or a screen is utilized, the flow path into the recirculation pump assembly 206 is essentially the same, which includes a change in flow direction and a reduction in flow, which facilitates deposition of particles from the incoming liquid into the chamber 216. In either embodiment, referring to FIGS. 6 and 8, the sump inlet 220 defines a first longitudinal axis 264, which is essentially coextensive with the longitudinal axis of the sump body 202. The recirculation pump inlet 232 defines a second longitudinal axis 268. The sump inlet 220 defines a first plane 266 and the recirculation pump inlet 232 defines a second plane 270. The planes 266, 270 define an included angle of less than or equal to 90 degrees. Maintaining a configuration with this angle facilitates the deposition of particles in the chamber 216.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An automatic clothes washer comprising:

a wash tub for holding wash liquid;

a wash basket located within the wash tub for holding items to be washed;

a wash liquid dispenser for introducing wash liquid into at least one of the wash tub and wash basket;

a sump located remotely of the wash tub and comprising a sump housing defining an elongated chamber having a central axis and a sump inlet located at one end fluidly connected to the wash tub such that wash liquid in the wash tub can flow through the inlet into the elongated chamber along a primary flow path and the central axis defines the primary flow path;

a recirculation pump having an inlet located along a side of the sump housing fluidly coupled to the elongated chamber, and an outlet fluidly coupled to the wash liquid dispenser for fluidly coupling the sump and the wash liquid dispenser to effect the recirculation of the wash liquid through the wash tub;

a drain pump having an inlet located along a side of the sump housing fluidly coupled to the elongated chamber, and an outlet fluidly coupled to a drain to effect the draining of water from the sump; and a separator located within the elongated chamber for removing objects entrained in the wash liquid, the separator having multiple through openings, with each of the through openings defining a through opening flow path, such that wash liquid flowing from the sump inlet to the recirculation pump inlet passes through at least one of the multiple through openings and the primary flow path defines an included angle of less than or equal to ninety degrees with at least one of the through opening flow paths.

2. The automatic clothes washer according to claim 1, wherein the primary flow path defines an included angle of less than or equal to ninety degrees with all of the through opening flow paths.

3. The automatic clothes washer according to claim 2, wherein the included angle is within the range of 30 to 50 degrees.

4. The automatic clothes washer according to claim 1, wherein the separator comprises multiple, spaced fins, with the space between adjacent fins defining a through opening.

5. The automatic clothes washer according to claim 4, wherein each fin defines a first axis, and the first axis of at least one of the fins defines an included angle of less than or equal to ninety degrees with the primary flow path.

6. The automatic clothes washer according to claim 5, wherein all of the first axes define an included angle of less than or equal to ninety degrees.

7. The automatic clothes washer according to claim 6, wherein all of the first axes define an included angle of 45 degrees.

8. The automatic clothes washer according to claim 5, wherein each fin defines a second axis, and the second axis of at least one of the fins defines an included angle between 50 and 90 degrees.

9. The automatic clothes washer according to claim 8, wherein all of the second axes define an included angle of 60 degrees.

10. The automatic clothes washer according to claim 4, wherein each fin forms a complex angle such that the spaced between adjacent fins defines a curved flow-through path having the through opening as its inlet.

11. The automatic clothes washer according to claim 10, and further comprising a barrier wall intersecting the fins and oriented substantially parallel to the primary flow path.

12. The automatic clothes washer according to claim 4, wherein the sump defines an interior height and at least one of the fins effectively spans the extent of the interior height.

13. The automatic clothes washer according to claim 12, wherein the fins in front of the reciprocating pump inlet effectively span the extent of the interior height.

14. The automatic clothes washer according to claim 13, wherein all of the fins effectively span the extent of the interior height.

15. The automatic clothes washer according to claim 1, wherein the separator comprises a screen having multiple openings forming the through openings.

16. The automatic clothes washer according to claim 1, wherein the drain pump inlet is located downstream of the recirculation pump inlet relative to the sump inlet.

17. The automatic clothes washer according to claim 16, wherein the sump housing further comprises a clean-out opening.

18. The automatic clothes washer according to claim 17, wherein the clean-out opening is located downstream of the drain pump inlet.

19. The automatic clothes washer according to claim 18, and further comprising a heater located within the sump.

20. The automatic clothes washer according to claim 19, wherein the heater is a heating element lying substantially flat along a portion of the sump housing.

21. The automatic clothes washer according to claim 20, wherein the heating element is a film heating element.

22. The automatic clothes washer according to claim 1, wherein the housing comprises a clean-out opening at an end opposite the sump inlet.

23. The automatic clothes washer according to claim 1, and further comprising a heating element located within the sump housing.

24. The automatic clothes washer according to claim 1, wherein the separator is oriented generally parallel to the central axis.

25. A sump for an automatic clothes washer comprising a wash tub for holding wash liquid, a wash basket located within the wash tub for holding items to be washed, a recirculation pump having an inlet fluidly coupled to the sump housing to effect the recirculation of the wash liquid through the wash tub, a drain pump having an inlet fluidly coupled to the sump housing to effect the draining of water from the sump, the sump being located remotely from the wash tub and comprising:

a sump housing defining a chamber having a longitudinal axis, the chamber having a first area orthogonal to the longitudinal axis and a second area orthogonal to the longitudinal axis greater than the first area, the sump housing having an inlet such that wash liquid can flow through the inlet into the chamber to define a primary flow path, the velocity of the flow of wash liquid through the second area being reduced from the velocity of the flow of wash liquid through the first area;

a separator located within the chamber and fluidly coupled with the recirculation pump inlet for removing objects entrained in the wash liquid, the separator comprising at least two spaced fins defining at least one through opening and at least one through opening flow path, the at least one through opening being oriented relative to the primary flow path such that the angle between the primary flow path and the at least one through opening flow path is no greater than ninety degrees;

wherein the second area is immediately adjacent the separator; and wherein the reduction in the velocity of the flow of wash liquid through the second area and the angle between the primary flow path and the at least one through opening flow path facilitate the deposition of particles suspended in the wash liquid.

* * * * *